US009851190B2

(12) United States Patent
Andersson et al.

(10) Patent No.: US 9,851,190 B2
(45) Date of Patent: Dec. 26, 2017

(54) ARRANGEMENT FOR LOCKING ARMING CONDITIONS

(71) Applicant: SAAB AB, Linköping (SE)

(72) Inventors: Bengt Andersson, Forshaga (SE); Per Karlsson, Örebro (SE); Filip Strand, Karlskoga (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 15/303,459

(22) PCT Filed: Apr. 11, 2014

(86) PCT No.: PCT/SE2014/000046

§ 371 (c)(1),
(2) Date: Oct. 11, 2016

(87) PCT Pub. No.: WO2015/156710

PCT Pub. Date: Oct. 15, 2015

(65) Prior Publication Data

US 2017/0023344 A1 Jan. 26, 2017

(51) Int. Cl.

| | |
|---|---|
| ***F41A 9/00*** | (2006.01) |
| ***F42C 15/24*** | (2006.01) |
| ***F42C 15/32*** | (2006.01) |
| ***F42C 15/36*** | (2006.01) |

(52) U.S. Cl.
CPC ..... *F42C 15/24* (2013.01); *F42C 15/32* (2013.01); *F42C 15/36* (2013.01)

(58) Field of Classification Search
USPC ..... 102/481, 202.1, 396, 416, 420, 424
See application file for complete search history.

(56) References Cited

U.S. PATENT DOCUMENTS 4,709,637 A * 12/1987 Boggero ..... F42C 15/36 102/378
5,445,077 A 8/1995 Dupuy et al.
5,735,114 A 4/1998 Ellingsen
(Continued)

FOREIGN PATENT DOCUMENTS

DE 4034630 A1 5/1992
FR 2685079 A1 6/1993
(Continued)

OTHER PUBLICATIONS

PCT/ISA/210—International Search Report—dated Dec. 16, 2014 (Issued in Application No. PCT/SE2014/000046).
(Continued)

*Primary Examiner* — J. Woodow Eldred
(74) *Attorney, Agent, or Firm* — Venable LLP; Jeffri A. Kaminski

(57) ABSTRACT

An arrangement for locking arming conditions to prevent unintentional arming of SAI-units of ammunition units when the ammunition unit is subjected to external threats. A ring shaped shape memory alloy is provided in cooperation with a recess in a plunger arranged in connection to the SAI-unit and a fixed recess to prevent the plunger from axial movement when subjected to heating by changing the shape of the essentially ring shaped shape memory alloy to lock the plunger relative to the fixed recess.

11 Claims, 3 Drawing Sheets

(56) References Cited

U.S. PATENT DOCUMENTS

| | | | | |
|---|---|---|---|---|
| 7,051,511 | B2 * | 5/2006 | Prytz | F42B 39/20 102/377 |
| 8,082,846 | B2 * | 12/2011 | Cook | F42B 39/14 102/377 |
| 8,925,463 | B1 * | 1/2015 | Sullivan | F42B 39/20 102/430 |
| 9,482,185 | B1 * | 11/2016 | Borrell | F02K 9/95 |
| 2004/0244358 | A1 | 12/2004 | Prytz | |
| 2008/0307951 | A1 | 12/2008 | Kaiser et al. | |
| 2010/0251881 | A1 | 10/2010 | Prytz et al. | |
| 2011/0192312 | A1 | 8/2011 | Toreheim et al. | |

FOREIGN PATENT DOCUMENTS

| | | | |
|---|---|---|---|
| FR | 2686410 | A1 | 7/1993 |
| FR | 2742221 | A | 6/1997 |
| GB | 2103340 | A | 2/1983 |
| SE | 519561 | C2 | 3/2003 |
| SU | 1323116 | A1 | 7/1987 |
| WO | 0203019 | A1 | 1/2002 |

OTHER PUBLICATIONS

PCT/ISA/237—Written Opinion of the International Searching Authority—dated Dec. 16, 2014 (Issued in Application No. PCT/SE2014/000046).

Search Report issued in counterpart European Patent Application No. 14888956.1, dated Oct. 12, 2017.

* cited by examiner

ARRANGEMENT FOR LOCKING ARMING CONDITIONS

CROSS-REFERENCE TO RELATED APPLICATIONS

The application is the national phase under 35 U.S.C. §371 of PCT/SE2014/000046 filed 11 Feb. 2014.

TECHNICAL FIELD

The present invention relates to an arrangement for locking arming conditions to prevent unintentional arming of SAI-units of ammunition units, such as projectiles, when the ammunition unit is subjected to external threats. In this connection SAI stands for Safety, Arming and Ignition and is a well-known component in the ammunition field.

BACKGROUND

Within the Insensitive Munitions (IM) field there are activities going on to find efficient solutions to protect weapon systems from external threats. In order to measure the IM-ability of a weapon system there are a number of standardized tests and threats available. The solution proposed is intended to prevent arming of an ammunition unit such as a projectile when subjected to a selected such standardized test to test "Slow cook-off".

The invention is primary intended to be used for preventing arming of projectiles of disposable one-man carried weapons. However, the invention could also be used in other existing ammunition types or ammunition types to come.

SUMMARY OF THE INVENTION

The main objects of the invention is to obtain an arrangement for locking arming conditions that is non-complicated in construction, reliable, cost effective, applicable to different types of SAI-units and fulfils the requirements of standardized heating tests.

The objects are obtained by an arrangement according to the first paragraph characterized in that an essentially ring shaped shape memory alloy is provided in cooperation with a recess in a plunger comprised in connection to the SAI-unit and a fixed recess to prevent the plunger from axial movement when subjected to heating by changing the shape of the essentially ring shaped shape memory alloy to lock the plunger relative to the fixed recess. The use of shape memory alloy to lock arming in connection to a SAI-unit when the ammunition unit is subjected to heating effectively fulfils the objects mentioned in the previous paragraph.

In this connection it can per se be observed that it is known to use shape memory alloys (SMA:s) to prevent undesired reactions within the insensitive munition field. One such example is known from FR 2 742 221 A1 disclosing ejection of a cap when a retaining member made from a material with shape memory effect is actuated by an excessive temperature. Another example is known from SE 519561 C2 disclosing a shape memory alloy designed to open up different parts of a casing when the surrounding temperature approaches the ignition temperature of an explosive.

It is also referred to U.S. Pat. No. 5,445,077 A disclosing an ignition device for a pyrotechnic system. The device provides an arming condition or fuse activated by a shape memory alloy when the temperature reaches a sufficiently high temperature. It is now a requirement that the fuse has been activated before the device can initiate (set fire to) the pyro technic. On the contrary our invention prevents an arming condition from being activated.

According to a favourable embodiment of the invention the arrangement is characterized in that the essentially ring shaped shape memory alloy is provided in cooperation with a pressure plunger controlling the pressure condition when arming the SAI-unit. Arranging the ring shaped shape memory alloy admits a compact construction and involves few reconstructions of constructions on the market.

In particular in a further embodiment according to the invention it is proposed that the pressure plunger is provided with a first and a second circular recesses provided in the envelope surface of the pressure plunger, the first circular recess accommodating a sealing ring and the second circular recess cooperating with the ring shaped shape memory alloy.

According to another favourable embodiment of the invention the arrangement is characterized in that the essentially ring shaped shape memory alloy and the plunger are provided inside the SAI-unit, the essentially ring shaped shape memory alloy in cooperation with the recess in the plunger and the fixed recess preventing the plunger from movement when subjected to heating by changing the shape of the essentially ring shaped shape memory alloy to lock the plunger relative to the fixed recess preventing activation of an external pressure plunger. This embodiment offers a complete and competent SAI-unit easy to accommodate in ammunition units.

The ring shaped shape memory alloy can be designed in different ways. According to one embodiment of the arrangement, the essentially ring shaped memory alloy is designed to expand radially when subjected to heating. According to another embodiment of the arrangement, the essentially ring shaped shape memory alloy is designed to contract radially when subjected to heating.

Furthermore the cross section of the essentially ring shaped shape memory alloy comprised in the arrangement can vary. In particular it is proposed that the essentially ring shaped shape memory alloy comprised in the arrangement originally has an essentially rectangular cross section, an essentially square cross section and/or an essentially round cross section.

According to still another favourable embodiment, the essentially ring shaped shape memory alloy comprised in the arrangement is provided with a break. Such a break can facilitate the expansion and contraction of the shape memory alloy.

In a common embodiment the essentially ring shaped shape memory alloy has a closed formation.

BRIEF DESCRIPTION OF THE DRAWINGS

The invention will now be described in more detail with reference to the accompanying drawings in which.

DETAILED DESCRIPTION

Figure 1:
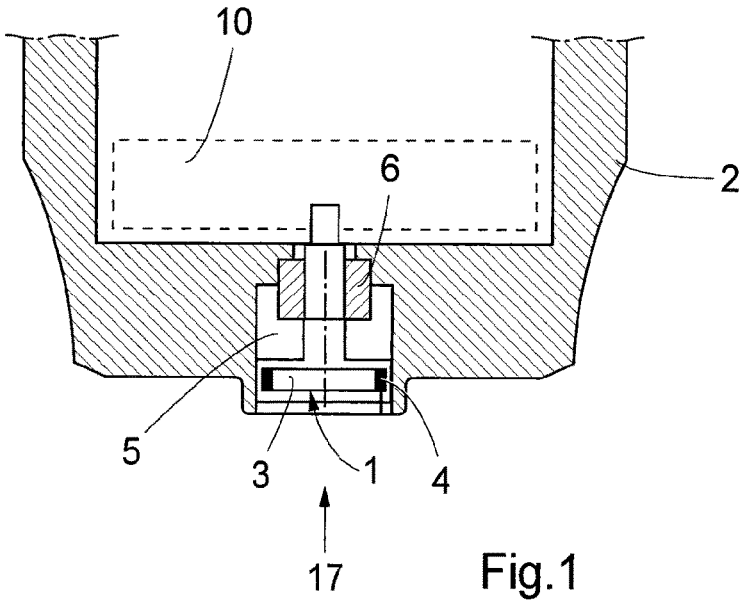
FIG. 1 schematically, partly in cross section, shows a known arrangement with a pressure plunger.

In the prior art arrangement shown in FIG. 1 there is a pressure plunger 1 provided in a SAI-holder, such as a fin holder 2. The pressure plunger is arranged to be moved further into the SAI-holder 2 by a pressure generated by propellant and indicated by an arrow 17. Within the SAI-holder 2 a SAI-unit has been indicated by dashed lines given reference number 10. The pressure plunger comprises a circular recess 3 accommodating a sealing O-ring 4. Under normal function, the pressure plunger 1 moves in a space 5 under control of a bearing 6 to a position fulfilling the arming pressure conditions.

Figure 2A:
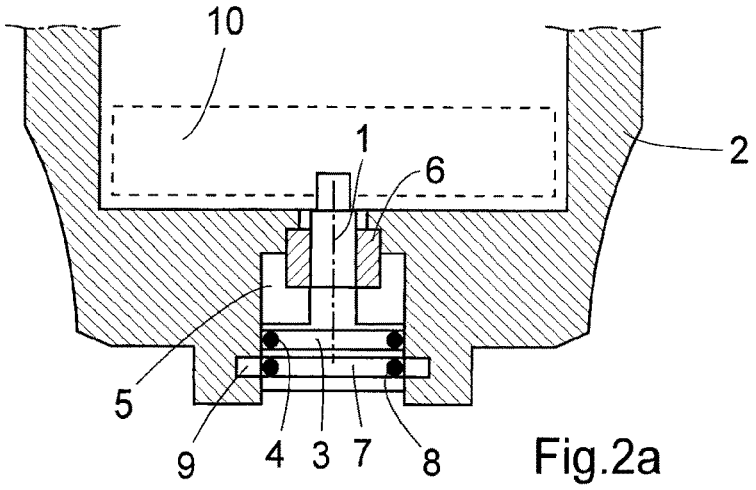
FIG. 2*a* schematically, partly in cross section, shows a first arrangement in accordance with the invention with a shape memory alloy in cooperation with a pressure plunger in an initial position.
Figure 2B:
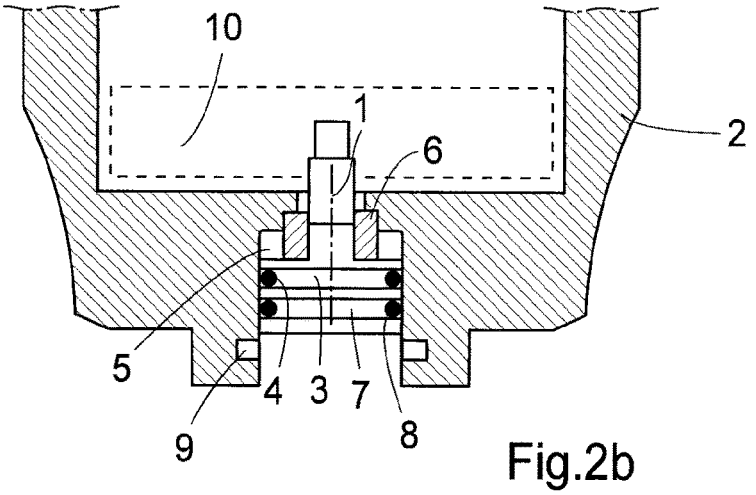
FIG. 2*b* schematically, partly in cross section, shows the arrangement of FIG. 2*a* following the normal function to fulfill the arming pressure conditions.
Figure 2C:
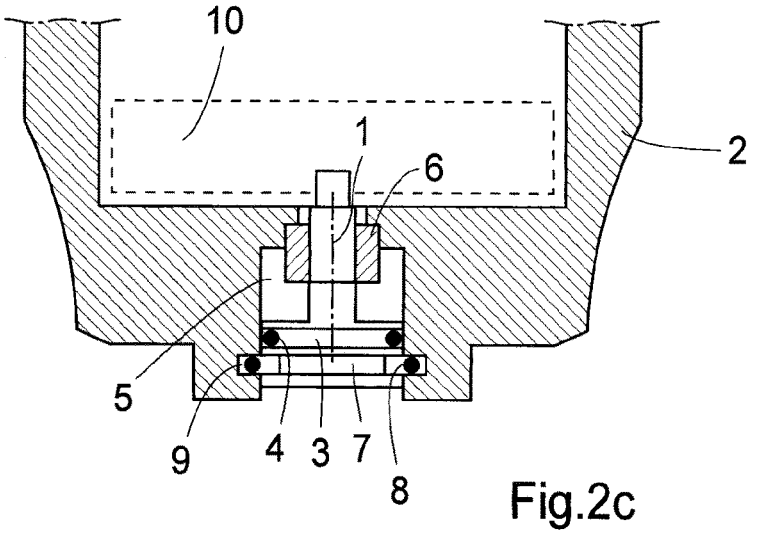
FIG. 2*c* schematically, partly in cross section, shows the arrangement of FIG. 2*a* when the arrangement has been subjected to heating.

According to a first arrangement according to the invention and shown in FIGS. 2*a*-2*c* a further circular recess 7 is provided to accommodate at least parts of a ring shaped shape memory alloy 8. There is also a circular recess 9 in the SAI-holder 2 initially at the same level as the recess 7 in the pressure plunger 1. Components described with reference to FIG. 1 and found in FIGS. 2*a*-2*c* have been given the same reference numbers. In comparison with the prior art arrangement described with reference to FIG. 1, the first arrangement according to the invention, has an extended plunger height and the space 5 has been adapted to the extended height of the plunger.

The operation of the arrangement is as follows.

Starting from FIG. 2*a* the pressure plunger is in its initial position with a sealing O-ring 4 to obtain a sealing between the pressure plunger 1 and the space 5. The ring shaped shape memory alloy 8 is in position in the recess 7 and does not prevent movement of the pressure plunger 1.

When subjecting the pressure plunger 1 to pressure generated by propellant, the pressure plunger 1 under normal function strikes a SAI-unit 10 indicated by dashed lines inside the SAI-holder 2 to fulfill the arming pressure conditions. It could be observed that the position of the shape memory alloy 8 don't have any noticeable effect on the movement of the pressure plunger 1, see FIG. 2*b*.

When subjected to heating according to a standardized test for example by raising the temperature around the arrangement by for example 3.3° C./h up to about 100° C., or by a comparable unintended temperature raise, the ring shaped shape memory alloy 8 will expand and assume a position as shown in FIG. 2*c* resulting in that the pressure plunger 1 is locket to a recess 9 in the SAI-holder 2 by the shape memory alloy 8.

Above a shape memory alloy 8 has been described that expands radially when subjected to heating. It is however also possible to use a shape memory alloy that initially is in an expanded condition outside the recess 7 of the pressure plunger 1 and that partly contradict into the recess 7 of the pressure plunger 1 when subjected to heating.

Figure 3A:
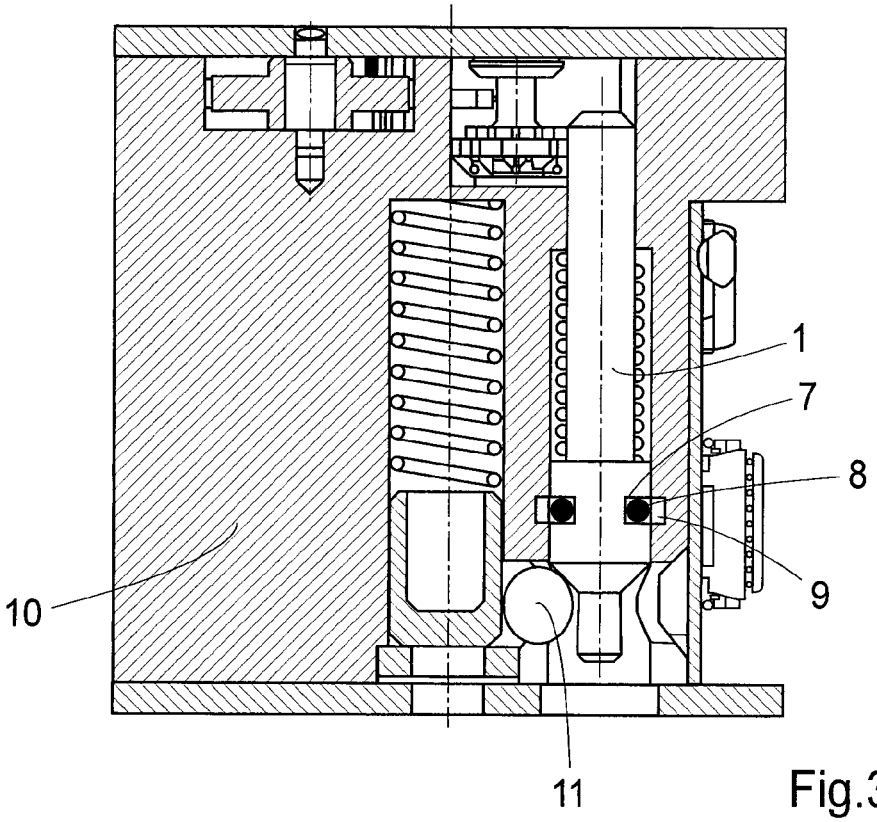
FIG. 3*a* schematically, partly in cross section, shows a second arrangement in accordance with the invention accommodating the shape memory alloy and plunger inside an SAI-unit.
Figure 3B:
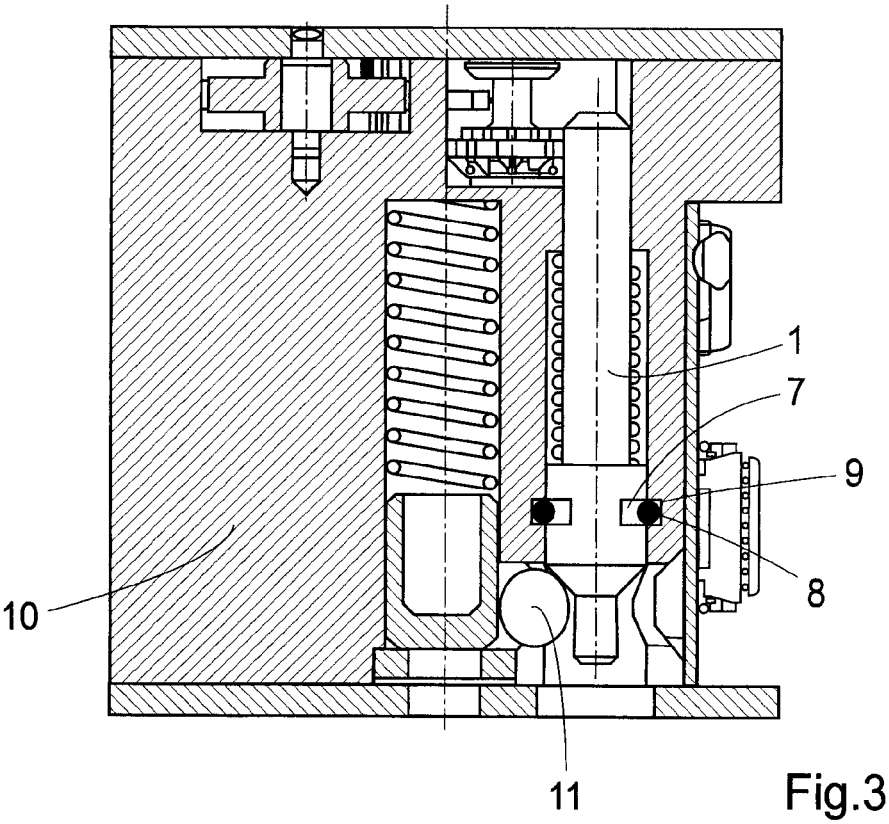
FIG. 3*b* schematically, partly in cross section, shows the arrangement of FIG. 3*a* when the arrangement has been subjected to heating.

A second arrangement is shown in FIGS. 3*a*-3*b*. In this case the plunger 1 is built in in the SAI-unit 10. In accordance with the first arrangement the plunger 1 is provided with a recess 7 accommodating a ring shaped shape memory alloy 8.

FIG. 3*a* shows the SAI-unit 10 in its initial position, the shape memory alloy being totally within the recess 7 so that the plunger 1 is free to move downwards in the shown figure if other arming requirements are fulfilled inter alia involving the component 11 to be set aside. If however the SAI-unit 10 is subjected to heating above levels set, the shape memory alloy 8 will expand into a recess 9, locking the pressure plunger 1 to the recess 9.

Figure 4A:
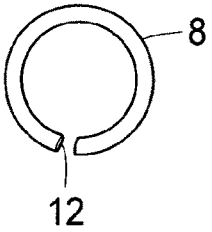
FIG. 4*a* schematically shows an example of a ring shaped shape memory alloy with a break and suitable for the arrangement in a constricted condition.
Figure 4B:
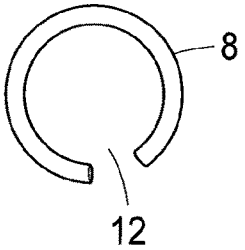
FIG. 4*b* schematically shows the ring shaped shape memory alloy of FIG. 4*a* in an expanded position.

FIGS. 4*a* and 4*b* schematically show a ring shaped shape memory alloy 8 provided with a break 12 in two different conditions illustrating how the shape memory alloy can be expanded or contradicted.

Figure 4C:
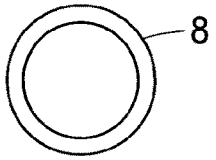
FIG. 4*c* schematically shows the ring shaped shape memory alloy in a closed formation in a constricted condition.
Figure 4D:
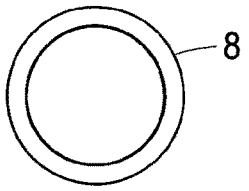
FIG. 4*d* schematically shows the ring shaped shape memory alloy of FIG. 4*c* in a closed formation in an expanded condition.

FIGS. 4*c* and 4*d* schematically show a ring shaped shape memory alloy 8 as a closed component in constricted condition, FIG. 4*c*, and in expanded condition, FIG. 4*d*.

Figure 5A:
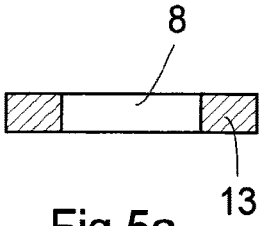
FIGS. 5*a*-5*c* schematically shows three examples of cross sections of the shape memory alloy suitable for the arrangement according to the invention.
Figure 5B:
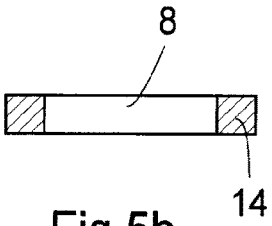
Figure 5C:
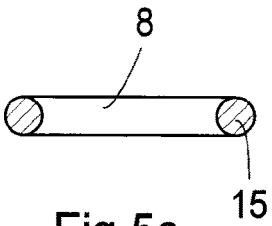

In FIG. 5*a*-5*c* three different cross sections for a ring shaped shape memory alloy 8 are shown. In FIG. 5*a* a rectangular cross section 13 is proposed. In FIG. 5*b* a square cross section 14 is shown and in FIG. 5*c* a circular cross section 15 is shown.

The arrangement for locking arming conditions is not limited to the examples described above but may be modified within the scope of the attached claims.

The invention claimed is:

1. An arrangement for locking arming conditions to prevent unintentional arming of Safety, Arming and Ignition units (SAI-units) of ammunition units when the ammunition unit is subjected to external threats, wherein an essentially ring-shaped shape memory alloy is provided which can assume a locking position to prevent a plunger from moving axially when subjected to heating by changing the shape of the essentially ring-shaped shape memory allowy whereby the essentially ring-shaped shape memory alloy by expansion or contraction becomes partly accommodated in a recess in the plunger and partly accommodated in a fixed recess in a SAI-holder whereby the plunger is locked relative to the fixed recess; said plunger being arranged partly in the SAI-unit or built-in in the SAI-unit.

2. The arrangement as claimed in claim 1, wherein the essentially ring-shaped shape memory alloy is provided in cooperation with a pressure plunger controlling the pressure condition when arming the SAI-unit.

3. The arrangement as claimed in claim 1, wherein the pressure plunger is provided with first and second circular recesses provided in an envelope surface of the pressure plunger, said first circular recess accommodating a sealing ring and said second circular recess cooperating with the ring-shaped shape memory alloy.

4. The arrangement as claimed in claim 1, wherein the essentially ring-shaped shape memory alloy and the plunger are provided inside the SAI-unit, the essentially ring-shaped shape memory alloy in cooperation with the recess in the plunger and the fixed recess preventing the plunger from movement when subjected to heating by changing the shape of the essentially ring-shaped shape memory alloy to lock the piston relative to the fixed recess preventing activation of an external pressure plunger.

5. The arrangement as claimed in claim 1, wherein the essentially ring-shaped shape memory alloy is designed to expand radially when subjected to heating.

6. The arrangement as claimed in claim 1, wherein the essentially ring-shaped shape memory alloy is designed to contract radially when subjected to heating.

7. The arrangement according to claim 1, wherein the essentially ring-shaped shape memory alloy originally has an essentially rectangular cross section.

8. The arrangement as claimed in claim 1, wherein the essentially ring-shaped shape memory alloy originally has an essentially square-shaped cross section.

9. The arrangement as claimed in claim 1, wherein the essentially ring-shaped shape memory alloy originally has an essentially round cross section.

10. The arrangement as claimed in claim 1, wherein the essentially ring-shaped shape memory alloy is provided with a break.

11. The arrangement as claimed in claim 1, wherein the essentially ring-shaped shape memory alloy has a closed formation.

* * * * *